United States Patent [19]

Collins

[11] 4,206,513

[45] Jun. 10, 1980

[54] NECKTIE MOLDING DEVICE AND METHOD OF USING

[76] Inventor: Robert Collins, 144 Shaw St., Garfield, N.J. 07026

[21] Appl. No.: 953,732

[22] Filed: Oct. 23, 1978

[51] Int. Cl.[2] ..... A41D 25/08; A41D 25/14

[52] U.S. Cl. ..... 2/152 R

[58] Field of Search ..... 2/152 R, 152 A, 153, 2/154, 145, 137; 24/49 R, 49 C, 49 S

[56] References Cited

U.S. PATENT DOCUMENTS

| | | | |
|---|---|---|---|
| 982,948 | 1/1911 | Griesemer | 2/152 A |
| 1,086,493 | 2/1914 | Wechsler | 2/153 |
| 1,706,252 | 3/1929 | Radis | 2/153 |
| 2,170,707 | 8/1939 | Chapel | 2/153 |
| 2,602,164 | 7/1952 | Di Venuti | 2/153 |

FOREIGN PATENT DOCUMENTS

| | | | |
|---|---|---|---|
| 930881 | 9/1947 | France | 2/153 |

*Primary Examiner*—H. Hampton Hunter

*Attorney, Agent, or Firm*—David A. Jackson

[57] ABSTRACT

A necktie molding device, comprising a longitudinally tapered, elongated, hollow member for forming a knot-like appearance in a necktie to be worn by a person. The necktie molding device also includes an extended base member.

4 Claims, 6 Drawing Figures

FIG. 1
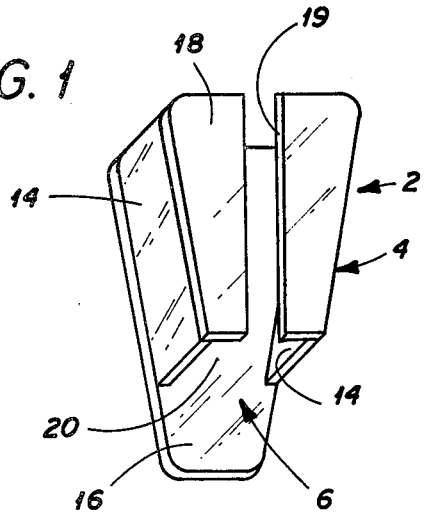
FIG. 2
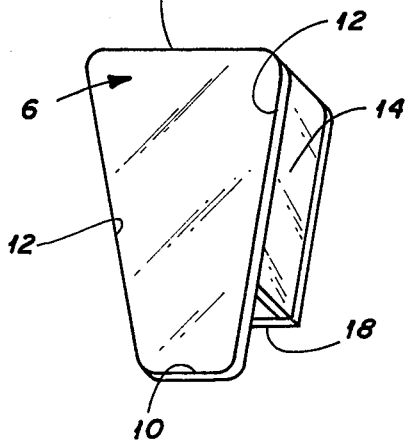
FIG. 3
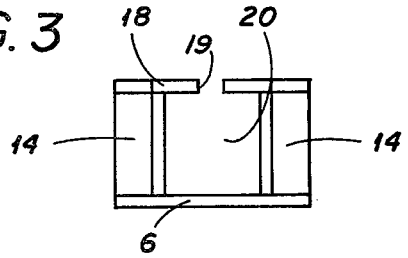
FIG. 4
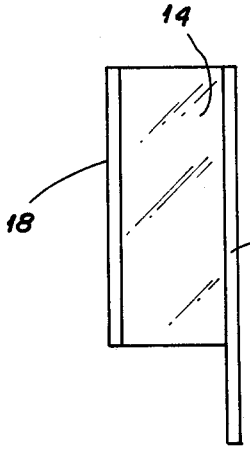
FIG. 6
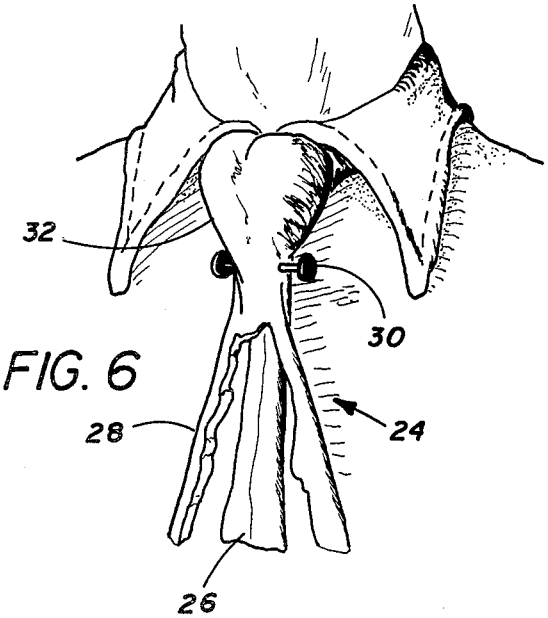
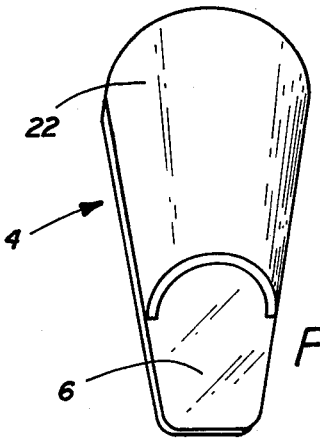
FIG. 5

NECKTIE MOLDING DEVICE AND METHOD OF USING

BACKGROUND OF THE INVENTION

This invention relates to a necktie molding device. More particularly, this invention relates to a necktie molding device which has specific utility in forming a knot in a necktie to be worn by a person and permitting easy adjustment of the necktie.

In today's society, the wearing of a necktie by a man is almost mandatory for any white collar job and for any formal evening entertainment. However, the art of donning a necktie is often an arduous task, requiring numerous attempts to attain an appropriate necktie knot and necktie length.

Several methods are known today for forming a knot in a necktie to be worn by a person. These methods do not require extraneous material for the forming of the knot. For example, one method includes the steps of placing the necktie about the neck of the user, crossing the two ends of the necktie hanging in front of the person, looing the decorative or wide end of the tie through the junction formed by the criss-crossed ends one or two times, wrapping the decorative or wide end around the juncture of the criss-crossed ends once, taking the wide end from behind the criss-crossed junction and looping it over the criss-crossed junction through the closed part of the necktie, and finally slipping the wide end through one of the wrapped around sections and adjusting the necktie to the neck of the user. Such a method requires a complicated procedure which is often inaccurate the first time.

In addition, by utilizing the above method of forming a knot in a necktie, there is much wear and tear on the material of the necktie. This wear and tear results from the stretching of the material into a tight knot and the sliding of the shorter or thin end of the tie through this tightly bound knot in order to adjust the necktie.

Accordingly, it is believed that the present invention provides a unique solution to the aforementioned problems

SUMMARY OF THE INVENTION

In accordance with the present invention, a necktie molding device is provided, comprising a longitudinally tapered, elongated, hollow member for forming a knot-like appearance in a necktie to be worn by a person. The necktie molding device also includes an extended base member.

Accordingly, it is a principal object of the present invention to provide a necktie molding device for forming a knot in a necktie to be work by a person.

It is a further object of the present invention to provide a necktie molding device that permits easy adjustment of the length of the necktie on a person.

It is a still further object of the present invention to provide a necktie molding device which reduces the wear and tear on the material of the necktie.

It is a yet further object of the present invention to provide a necktie molding device which is easy to use and economical to manufacture.

Further objects and advantages will become apparent to those skilled in the art from the ensuing description which proceeds with reference to the accompanying figures.

BRIEF DESCRIPTION OF THE DRAWINGS

FIG. 1 is a partial phantom, perspective view of one embodiment of the present invention looking from a top perspective view.

FIG. 2 is a perspective view of the embodiment of the present invention of FIG. 1 taken from a bottom perspective view.

FIG. 3 is a side plan view of the present invention of FIG. 1 looking from the wider end of the device.

FIG. 4 is a side plan view of the embodiment of FIG. 1 taken along a longitudinal side.

FIG. 5 is a perspective view of a second embodiment of the present invention.

FIG. 6 is a plan, partially broken away view of how a necktie would look on a person utilizing the present invention.

DETAILED DESCRIPTION OF THE INVENTION

Referring to the drawings, wherein like numerals represent like parts, and particularly to FIG. 1, the present invention includes a necktie molding device 2 comprising a longitudinally tapered, elongated, hollow member 4 for forming a knot-like appearance in a necktie to be worn by a person.

FIGS. 1–4 disclose a first preferred embodiment of hollow member 4 of the present invention. Hollow member 4 includes a tapered base member 6 of a substantially flat dimension. Base member 6 includes a first wide end 8 which tapers on both sides to a second narrower end 10. Attached to base member 6 on one side thereof along the tapered side edges 12 are upstanding side panels 14. Side panels 14 are preferably of a substantially flat, rectangular configuration, attached along their longitudinal edges to side edges 12 at right angles thereto. The longitudinal sides of side panels 14 are of a lesser dimension than tapered side edges 12 of base member 6. Side panels 14 are attached to side edges 12 such that the ends of side panels 14 are in substantial alignment with the first wide end 8 of base member 6. In this manner, base member 6 is of an extended nature, forming an extension or tongue 16 which extends past the ends of side panels 14. Attached to the opposite longitudinal sides of side panels 14 is a roof member 18 of substantially identical dimension to base member 6 except that the tapered sides of roof member 18 are of substantially equal dimension to the longitudinal sides of side panels 14 such that roof member 18 does not extend past side panels 14. In this manner, necktie molding device 2 is of a longitudinally tapered, elongated, hollow, rectangular, cross-sectional configuration having a longitudinal tapered aperture 20 therein.

Referring to FIG. 5, a second embodiment of the present invention is shown including a hollow member 4 having a base member 6 as previously described. Replacing side panels 14 and roof member 18 is a thin shelled hemi-cylindrical member 22 of a longitudinally tapered configuration.

Referring to FIG. 1, device 2 may also include a centrally oriented longitudinal slit 9, shown in phantom, along the length of roof member 18 for easy accessibility of narrow end 26 of the tie within aperture 20. In like manner, the embodiment of FIG. 5 may include a similar longitudinal slit (not shown).

It is to be appreciated that, although device 2 was described above by a plurality of sections, device 2 may be integrally molded in one piece. In this manner, device 2 may be manufactured from any suitable material such as a durable plastic.

In operation, referring to the Figures, a necktie 24 is placed about the neck of the user, with the narrow or nondecorative end 26 of necktie 24 being disposed through tapered aperture 20 from wide end 8 towards narrower end 10 with base member 6 being disposed towards the body of the user. The wide or decorative end 28 of necktie 24 is then criss-crossed over necktie molding device 2 and wrapped around device 2, and more particularly, base member 6, side panels 14 and roof member 18, two times. Wide or decorative end 28 is then taken from behind molding device 2, i.e., on the unattached side of base member 6, and placed through the looped part of the necktie and over roof member 18 of necktie molding device 2. Narrow end 26 is then held by the user and necktie molding device 2 is then slid along narrow end 26 until the appropriate position of necktie molding device 2 is reached near the neck of the user. In this manner, it can be seen that less wear and tear occurs on the material of necktie 24 in adjusting the tie since necktie molding device 2 may be moved along narrow end 26 rather than a tightly bound knot doing the same. After wide end 28 of necktie 24 is disposed over roof member 18, wide end 28 is stretched or wrapped around roof member 18 and side panels 14 of hollow member 4 and pinched just behind tongue 16 where it is secured in its pinched position by a securing or stick pin 30. In this manner, necktie 24 is adjusted to the neck of the user while also forming an appropriate necktie knot 32 therein.

It is to be appreciated that there is less wear and tear on the material of necktie 24 by utilizing necktie molding device 2 since necktie 24 does not form a tightly bound knot.

It is to be understood that the invention is not limited to the illustrations described and shown herein which are deemed to be merely illustrative of the best modes of carrying out the invention, and which are suitable of modification of form, size, arrangement of parts and details of operation. The invention rather is intended to encompass all such modifications which are within the spirit and scope as defined by the claims.

What is claimed is:

1. A necktie molding device comprising a longitudinally tapered, elongated hollow rigid member defining a correspondingly tapered aperture for the reception of the narrow portion of a necktie, said hollow member comprising:

a flat base having inwardly tapering, longitudinally extending side edges;

paired, angularly disposed, upstanding side panels defining longitudinal edges, each side panel perpendicularly attached to said side edges along a longitudinal edge thereof;

a roof attached to the free longitudinal edges of said side panels and extending therebetween;

a planar, tapering tongue extending from the tapering end of said base and beyond the terminus of said side panels and said roof, said tongue providing a brace for the positioning of a securing pin passing therebehind and through the lateral edges of said necktie, whereby said necktie is held in a knot-like shape.

2. The necktie molding device of claim 1 including a longitudinal slit centrally provided along said roof member.

3. The device of claim 1 wherein said side panels and said roof are integral with each other.

4. A method for donning a necktie, comprising the steps of:

placing a necktie about a user's neck, said necktie including a first wide end and a second narrow end;

disposing said narrow end through a necktie molding device, said necktie molding device comprising a longitudinally tapered, elongated hollow member rigid defining a corresponding tapered aperture for the reception of said narrow end, and including a planar, tapering tongue extending from the tapering end thereof;

wrapping said wide end at least one time around said hollow member, thus forming a necktie loop about the neck of the user;

disposing said wide end through said necktie loop from under said necktie molding device and over said necktie molding device;

sliding said necktie molding device along said narrow end into the proximity of the neck of said user;

pinching said wide end at the base of said necktie molding device and about said tongue; and securing said pinched wide end by a securing pin through the lateral edges of said wide end and behind said tongue.

* * * * *